United States Patent [19]

Brücher et al.

[11] 4,364,983

[45] Dec. 21, 1982

[54] MULTIFILAMENT YARN OF INDIVIDUAL FILAMENTS OF THE MULTICOMPONENT MATRIX/SEGMENT TYPE WHICH HAS BEEN FALSETWISTED, A COMPONENT THEREOF SHRUNK, A COMPONENT THEREOF HEATSET; FABRICS COMPRISING SAID

[75] Inventors: Walter Brücher, Wuppertal; Karl H. Hense, Erlenbach; Reiner Modtler, Wuppertal, all of Fed. Rep. of Germany

[73] Assignee: Akzona Incorporated, Asheville, N.C.

[21] Appl. No.: 125,097

[22] Filed: Feb. 27, 1980

[30] Foreign Application Priority Data

Mar. 2, 1979 [DE] Fed. Rep. of Germany ..... 2908101
May 7, 1980 [DE] Fed. Rep. of Germany ..... 8012389

[51] Int. Cl.[3] ..... D02G 1/20; D03D 27/00

[52] U.S. Cl. ..... 428/85; 28/159; 28/162; 28/166; 28/167; 28/168; 57/284; 428/97; 428/370; 428/374

[58] Field of Search ..... 28/159, 162; 57/284; 28/166, 167, 168; 428/97, 85, 370, 374

[56] References Cited

U.S. PATENT DOCUMENTS

| | | | |
|---|---|---|---|
| 3,853,977 | 12/1974 | Matsui et al. | 264/171 |
| 3,966,865 | 6/1976 | Nishida et al. | 264/171 |
| 4,051,287 | 9/1977 | Hayashi et al. | 28/162 |
| 4,239,720 | 12/1980 | Gerlach et al. | 264/171 |

FOREIGN PATENT DOCUMENTS

| | | | |
|---|---|---|---|
| 2724164 | 9/1978 | Fed. Rep. of Germany | 28/162 |

*Primary Examiner*—James C. Cannon
*Attorney, Agent, or Firm*—Francis W. Young; Jack H. Hall

[57] ABSTRACT

A multifilament yarn consisting of single filaments of the multicomponent matrix-segment type where the individual components of the yarn show a false-twist crimp and where all or part of the individual components, consisting of the matrix and at least three segment fibers split off such matrix, said segment fibers having shrunk by at least 10% in relation to the matrix fiber, are bonded to each other at irregular intervals.

14 Claims, 7 Drawing Figures

Figure 1:
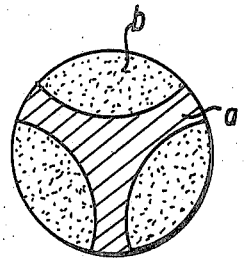

MULTIFILAMENT YARN OF INDIVIDUAL FILAMENTS OF THE MULTICOMPONENT MATRIX/SEGMENT TYPE WHICH HAS BEEN FALSETWISTED, A COMPONENT THEREOF SHRUNK, A COMPONENT THEREOF HEATSET; FABRICS COMPRISING SAID

The invention relates to the multifilament yarn of individual filaments of the multicomponent matrix/segment type, which yarn contains the individual filaments essentially as matrix and as at least three segment fibers split therefrom, whereby the segment fibers exhibit at least 10% shrinkage with respect to the matrix fibers. The invention relates furthermore to a process for the production of the yarn of the invention.

Yarns of individual filaments of the multicomponent matrix/segment type are described in copending U.S. patent applications Ser. No. 6,491, filed Jan. 25, 1979, now abandoned, and Ser. No. 16,560, filed Mar. 1, 1979, now U.S. Pat. No. 4,239,720, which are incorporated herein by reference. They are composed of at least two different polymers having distinctly different shrinkage behavior. By developing said differential shrinkage complete or total separation of the components can be achieved.

It has now been found that, under certain conditions, surprising effects are achieved during falsetwist texturing of yarns of the above described type by judicious selection of the combination of polymers being processed and of the texturing conditions.

The object of the invention is, therefore, to provide a yarn of individual filaments of the multicomponent matrix/segment type having very good processing characteristics in sheet structures without twisting, sizing or other treatments to obtain bonds between the individual filaments of the yarn and exhibiting in the finished sheet structure a very fine individual filament denier for the components of the yarn.

This is accomplished according to the invention by a multifilament yarn from individual filaments of the multicomponent matrix/segment type containing said individual filaments essentially as matrix and as at least three segment fibers split therefrom, whereby the segment fibers are shrunk at least about 10% with respect to the matrix fiber, characterized in that the individual components forming the yarn have a false-twist texture and in that individual components are completely or partly bonded within the yarn unit at irregular intervals by bonding sites involving all or part of the yarn cross section. The matrix component may be composed of polyamide and the segment components of polyalkylene terephthalate. A combination whereby the matrix component is polycaprolactam and the segment component polyethylene terephthalate is especially suitable.

According to the invention, the weight ratio of matrix to segment components should range from about 5:95 to 45:55 and preferably from 10:90 to 25:75. Furthermore, the denier of the segment components of the yarn are preferably uniform and from about 0.08 to about 2.0 and preferably from about 0.1 to about 1.4 (dtex).

According to the invention, the described yarns can be obtained by a process characterized in that a multifilament yarn of individual filaments of the multicomponent matrix/segment type is subjected to a falsetwisting treatment during which a setting temperature is applied which corresponds to at least the minimum temperature required to heatset the component having the lowest melting point, and thereby to achieve a twist density, as a function of the total denier of the multifilament yarn, between about 1500 and 4500 turns per meter.

The setting temperature ranges advantageously between about 180° C. and 240° C. and preferably between about 190° C. and 230° C.

It has been found that the twist density in the setting zone is advantageously selected to correspond to the conventional twist density used in texturing standard multifilament polyethylene terephthalate yarn of about the same denier.

In addition to continuous multifilament, linear structures of continuous fibers or staple fiber, yarns within the framework of the invention also include sheet structures such as woven, knitted, laid fabrics, webs, etc.

In one application of the multifilament yarns of the invention, the filaments are subjected to a falsetwisting treatment at a setting temperature of about 190° to 240° C. to thereby cause the filaments to bond to each other at points of intersecting, e.g., at about 5 to 40, and preferably about 10–40, bonding points per meter. The yarn is processed into a sheet structure; the sheet structure e.g., a fabric or textile material, is then subjected simultaneously to treatment with an organic solvent reducing the zero shrinkage temperature of the segment polymer(s) by at least 160° C. and to a milling treatment. The milling treatment should be very vigorous to prevent subsequent alteration of the hand during use.

The falsetwisting method is advantageously a draw-texturing method, whereby the draw ratio is selected in an otherwise known manner as a function of the desired end product.

Methylene chloride, 1,1,2,3-tetrachloroethane, 1,1,2-trichoroethane and chloroform are especially effective organic solvents.

Shrinkable, as used herein, signifies that the segment component fibers can be shrunk, e.g., by treatment with certain solvents disclosed herein. It is important that the segment components exhibit a marked shrinkage in the solvents of the invention; said shrinkage should expediently amount to at least 10, preferably at least 15%. The average expert in the field will know how the shrinkage behavior can be determined.

It is essential that matrix and segment components exhibit a differential shrinkage behavior in the solvent; e.g., the segments may shrink while the matrix does not, or segments and matrix may shrink to a different degree. However, the induction time, i.e., the time until the shrinkage assumes a marked dimension in the treatment medium must vary. With the process of the invention, it is important that the shrinkage induction time be as short as possible for the segment components and preferably of an order of magnitude of only seconds. The difference in shrinkage behavior may also consist in that the peripheral segments have a higher shrinkage rate/velocity than the matrix. Details on the determination of the induction time are given in the two papers of N. L. Lindner in Colloid and Polymer Sci. 225, 213 et seq., and 433 et seq. (1977).

The filaments of the matrix/segment type which form the basis of the invention are composed of polymers which are non-miscible and do not react chemically with one another, and exhibit a distinct phase boundary, especially when blended together in a melt or when spun side-by-side as components of a multicomponent fiber. Chief among such incompatible polymers are polyamides and polyester whereby polyester based on terephthalic acid is preferred within the framework of the invention. These two polymers do not exhibit any perceptible chemical reaction in the melt with one another, at least within limited periods of time, so that virtually no heteropolymers will be formed which would cause the two phases to be bonded more solidly together. It is understood that exchange reactions which may occur after a prolonged time between polyester and polyamide, e.g., as covered in Doklady Akademii Nauk SSSR 1962, Vol. 147, No. 6, pp. 13, 165-8, are not taken into consideration.

Figure 2:
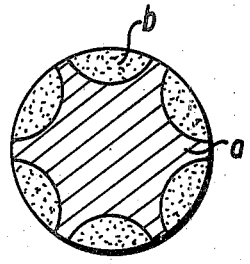
Figure 3:
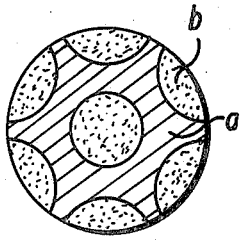
Figure 4:
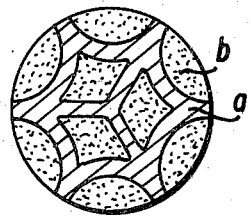
Figure 5:
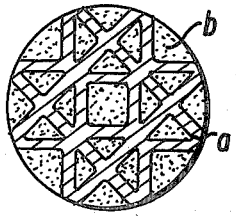
Figure 6:
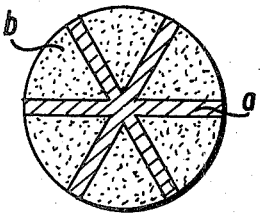
Figure 7:
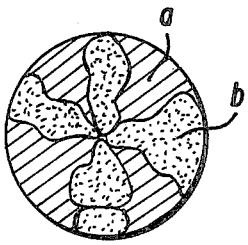

Matrix component filaments with matrix and a multisegment arrangement of the components relate to filaments in which individual segments and matrix are aligned continuously along the filament axis so that the filament cross section is essentially identical along the length of the filament. Examples of suitable cross sections within the framework of the invention are illustrated in FIGS. 1 to 7, whereby "a" represents the matrix and "b" the segments.

Organic solvents according to the invention relate to chemical substances able to physically dissolve other substances. It is not required and, as a rule, it is even undesirable that the solvents dissolve any or all polymers constituting the multicomponent fibers. In other cases, it may be desirable to use solvents which are able to dissolve the matrix component, either partly or completely, after processing to a sheet structure. In any case, the solvent should cause the segment fibers to shrink substantially, with little or no shrinkage of the matrix.

The zero shrinkage temperatures can be determined by a method as outlined in Lenzinger Berichte, May 1976, Supplement 40, pp. 22–29. It involves the determination of the dynamic shrinkage curve of filaments in the solvent earmarked for treatment of the multicomponent filaments or yarns. By extropolation of the linear portions of the dynamic shrinkage curve, one obtains the zero shrinkage temperature at the point of intersection with the abscissa.

It has been found that, according to the invention in particular, the solvents mentioned above, namely methylene chloride, 1,1,2,2-tetrachloroethane, 1,1,2-trichloroethane and chloroform lead to a sufficient lowering of the zero shrinkage temperature of the segment polymer to bring about an unexpected favorable splitting of the multicomponent filaments.

Multicomponent filaments of the type required as initial material according to the invention can be obtained by different procedures, whereby making use of proper spinnerets and spinning devices, suitable polymers are spun by the melt spinning process and conventionally drawn. Said multicomponent filaments can be obtained very advantageously according to a process and with a device as described in the aforementioned copending patent application, Ser. No. 6,491, filed Jan. 25, 1979.

A very important role is also played according to the invention by the selection of the (weight) fractions of matrix and segment components. It has been found that, especially with filaments within a range of about 10 to 25 weight percent matrix fraction, dissolution of the bonding points is very much facilitated providing setting temperatures of 225°–230° C., at most about 235° C., are not exceeded.

Decisive factors for the structure of the finished yarn of the invention are generally the distribution of matrix and segment components, the twist level and especially the setting temperature level. It has been found that, especially to be able to achieve—if at all—the effect of the invention, a heat-setting or thermosetting temperature must be selected which is at least as high as the setting temperature required for the filament component having the lowest melting point, i.e., the filament component forming the matrix.

The more this temperature is exceeded, the greater the number, not only of bonding points present after the texturing process, but also of indissoluble bonding points.

It is thus possible, by varying the setting temperature to obtain a wide range of different so-called hand qualities in the sheet structure. Combining the treatment with the solvent with a simultaneous milling treatment also results in various effects. This treatment must be thorough enough to prevent the hand of the material from undergoing changes when worn or in use, due to the dissolving or breaking additional bonding points between matrix and segment components.

The matrix profile is selected in keeping with the desired end properties. The finer an individual segment denier is desired, the greater must be the number of segment components per matrix component.

Splitting of the textured multicomponent filaments, especially dissolving of the bonding points, is possible not only with structures such as staple fiber or continuous filaments, but also with structures which are obtained by processing the textured multicomponent filaments or yarns into textile or other sheet structures.

Sheet structures such as knitted, warpknitted and woven fabrics obtained from textured yarn produced according to the invention having at least about 10 and up to about 40 bonding points per linear meter of yarn are especially useful.

In cases where the matrix component of the yarns used as feedstock represents the smaller fraction, e.g., up to about 15 weight %, selection of a suitable setting temperature for texturing may result in that the segment components are recognizable in the finished yarn, while the matrix has been broken up and clings to the segment fibers in fragments of different sizes which are in part so small as to be below the resolution of a light microscope. In this case, it may indeed be advantageous to dissolve the matrix component from the sheet structure to leave behind only the very fine denier segment components, for example, a filament denier of about 0.1 to 0.3 dtex.

We claim:

1. A multifilament yarn of individual filaments of the multicomponent matrix/segment type containing the individual filaments essentially as matrix segment and at least three individual filaments split off therefrom as segment fibers, whereby the segment fibers have been shrunk at least about 10% with respect to the matrix fiber, wherein said individual filaments of the yarn exhibit a falsetwist texture and said individual filaments are bonded to each other within the yarn unit at irregular intervals by means of bonding sites involving all or part of the filament cross section.

2. The yarn of claim 1, wherein said matrix component is composed of polyamide and said segment components of polyalkylene terephthalate.

3. The yarn of claim 2, wherein said matrix component is polycaprolactam and said segment components are polyethylene terephthalate.

4. The yarn of claims 1 to 3, wherein the weight ratio of matrix to segment component is about 5:95 to 45:55.

5. The yarn according to claim 4, wherein the weight ratio of matrix to segment components is about 10:90 to 25:75.

6. The yarn according to claim 5, wherein said segment components have uniform individual deniers, ranging between about 0.08 to 2.0 dtex.

7. The yarn according to claim 6, wherein said segment components have individual deniers ranging between about 0.1 and about 1.4 dtex.

8. The yarn of claim 1, wherein the density of said falsetwist texture is from about 1500 to about 4500 turns per meter.

9. The yarn of claims 1 and 8, wherein the number of said bonding sites averages from about 5 to 40 per meter.

10. The yarn of claim 9, processed into a sheet structure, said sheet structure being subjected simultaneously to treatment with an organic solvent lowering the zero shrinkage temperature of the segment polymer by at least 160° C. and a milling treatment, whereby from about 50 to about 80% of said bonding sites are dissolved.

11. A process for the production of a multifilament yarn comprising falsetwisting a multifilament yarn of individual filaments of the multicomponent matrix/segment type at a temperature at least as high as that required to heatset the component with the lowest melting point to achieve a twist density, as a function of the total denier of the multi-filament yarn, of between about 1500 and 4500 turns per meter and an average of from about 5 to about 40 bonding sites per meter between said individual filaments.

12. The process of claim 11, wherein the settting temperature is in the range between about 180° C. and 240° C.

13. The process of claim 12, wherein the setting temperature is in the range of about 190° C. and 230° C.

14. A process for the production of a textile sheet structure comprising falsetwisting a multifilament yarn of individual filaments of the multicomponent matrix/segment type at a heatsetting temperature in the range from about 180° C. to about 240° C., whereby said individual filaments are bonded to each other at from 10 to 40 bonding points per meter, forming a textile sheet structure from said multifilament yarn and subjecting said textile to treatment with an organic solvent which will lower the zero shrinkage temperature of the segment polymer(s) by at least 160° C., and simultaneously, subjecting said textile sheet structure to a milling treatment.

* * * * *

UNITED STATES PATENT AND TRADEMARK OFFICE

CERTIFICATE OF CORRECTION

PATENT NO. : 4,364,983

DATED : December 21, 1982

INVENTOR(S) : Walter Brucher, Karl Hense and Reiner Modtler

It is certified that error appears in the above—identified patent and that said Letters Patent is hereby corrected as shown below:

Insert at the end of the title after "SAID" the word

--YARN--.

Signed and Sealed this

*Fifteenth* Day of *March 1983*

[SEAL]

*Attest:*

GERALD J. MOSSINGHOFF

*Attesting Officer*

*Commissioner of Patents and Trademarks*